US007644668B2

(12) United States Patent
Kuo et al.

(10) Patent No.: US 7,644,668 B2
(45) Date of Patent: Jan. 12, 2010

(54) FEEDING SYSTEM FOR PLASMA MELTING-FURNACE

(75) Inventors: Mau-Suei Kuo, Taipei (TW); Tsung-Min Hung, Taipei (TW); Wen-Cheng Li, Bade (TW)

(73) Assignee: Atomic Energy Council, Taoyuan (TW)

( * ) Notice: Subject to any disclaimer, the term of this patent is extended or adjusted under 35 U.S.C. 154(b) by 321 days.

(21) Appl. No.: 11/260,419

(22) Filed: Oct. 28, 2005

(65) Prior Publication Data

US 2007/0095258 A1 May 3, 2007

(51) Int. Cl.
*F23G 5/00* (2006.01)

(52) U.S. Cl. ..... 110/250; 110/255; 110/101 R

(58) Field of Classification Search ..... 110/237, 110/242, 250, 255, 101 R, 346, 223; 976/DIG. 393, 976/DIG. 394, DIG. 395, DIG. 384; 373/22
See application file for complete search history.

(56) References Cited

U.S. PATENT DOCUMENTS

| | | | | | |
|---|---|---|---|---|---|
| 4,784,802 | A * | 11/1988 | Mallory et al. | ..... | 588/17 |
| 5,066,936 | A * | 11/1991 | Hsu | ..... | 335/295 |
| 5,452,671 | A * | 9/1995 | Wagner | ..... | 110/346 |
| 6,355,904 | B1 * | 3/2002 | Batdorf et al. | ..... | 219/121.59 |
| 6,715,343 | B1 * | 4/2004 | Henry et al. | ..... | 73/40 |
| 2007/0039487 | A1 * | 2/2007 | Hung et al. | ..... | 99/470 |

* cited by examiner

*Primary Examiner*—Kenneth B Rinehart
(74) *Attorney, Agent, or Firm*—Jackson IPG PLLC

(57) ABSTRACT

The present invention provides a feeding system which operates under an environment of negative pressure on feeding waste materials to prevent contaminant of a plasma furnace from leakage and so can be used in related industries of processing radioactive wastes.

10 Claims, 4 Drawing Sheets

FEEDING SYSTEM FOR PLASMA MELTING-FURNACE

FIELD OF THE INVENTION

Figure 1:
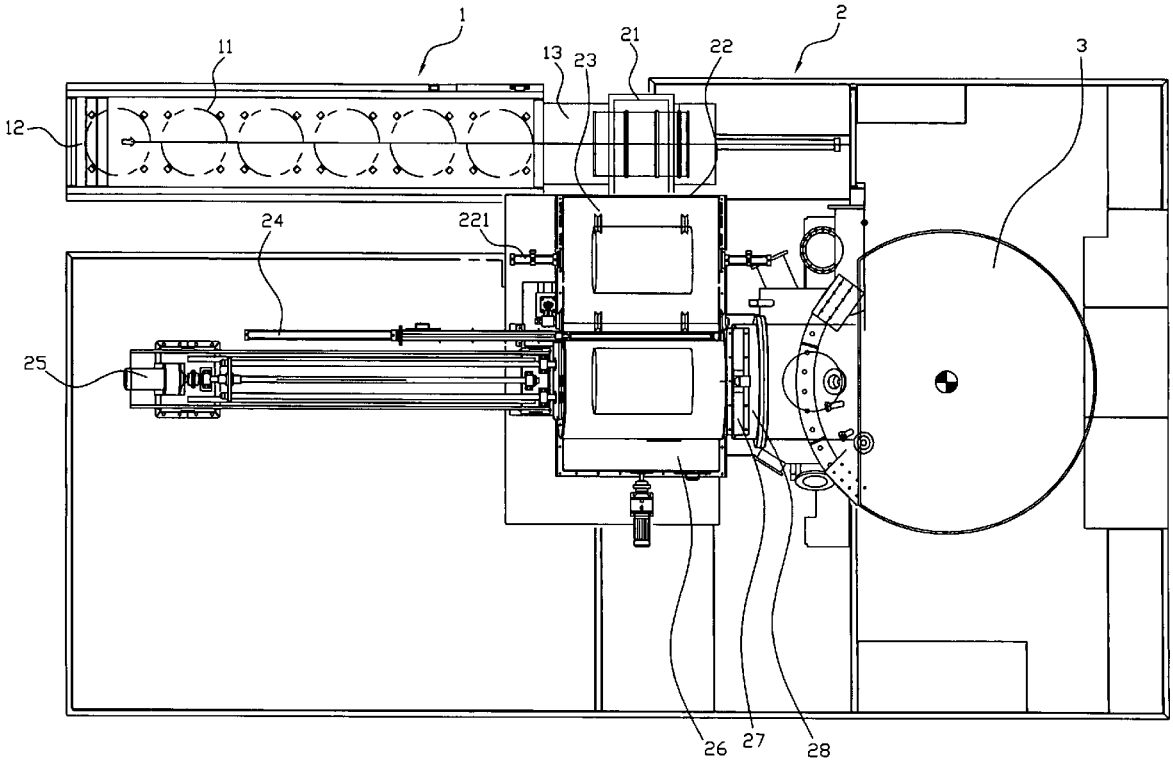

The present invention relates to a feeding system; more particularly; relates to a system for feeding waste materials to a plasma melting-furnace, where the system comprises a material carrying unit and a material feeding unit; the material carrying unit comprises a carrying device and a toppling unit; the material feeding unit comprises three feeding rooms; one feeding room comprises a feeding lid and the three feeding rooms are separated by a first gate and a second gate; and, by mutually opening and shutting between the feeding lid, the first gate and the second gate for feeding waste materials, the present invention can be used in related fields of industry for processing radioactive wastes or operating poisonous and high-temperature processes.

DESCRIPTION OF THE RELATED ART

Plasma-torch technology which is used in handling waste is getting mature On handling the waste using plasma torch, a plasma furnace is operated under 1650° C. So, some urgent issues need to be solved for achieving best efficiency, which are the damages possibly caused to the feeding system under a high-temperature operation, and the pollution to the factory owing to a leakage of exhausted gas from the plasma furnace.

A general incinerator is fed with materials in a manual way. When processing a radioactive waste, an operator is a way to the radioactive waste as possible under a reasonable low radioactivity. Yet, when feeding the waste manually, the operator receives more radiation dose. Hence, a prior art, "A feeding system of automatic machinery for an incinerator", is proclaimed in Taiwan, where a main frame of a material-feeding trough comprises a furnace opening, a feeding inlet, a waste pusher, a furnace-opening pusher, a feeding-inlet pusher, a feeding-board pusher, a trough pillar and a rubber roller. Beside the main frame of the material-feeding trough is a device for lifting and toppling waste material. The device for lifting and toppling waste material comprises a waste lifter, a motor for the waste lifter, a steel-rope driving-wheel, a direction-changing fixed pulley, a vertical rail, a toppling rail, a collecting cart and a collecting wagon. The collecting cart comprises a cart main frame, a cart sheathing, a moving pulley and a pushing handle. The collecting wagon is coordinated to the size and shape of the collecting cart for containing the collecting cart, which comprises a wagon frame, a wagon sheathing, a positioning pulley and a steel-rope drawing-board. With the above structure, the feeding system collects wastes and topples them into the incinerator directly and automatically. But the prior art is functioned under 700~900° C., which can not be applied to melt a waste bucket in a plasma furnace under 1650° C. Hence, the prior art does not fulfill users' requests on actual use.

SUMMARY OF THE INVENTION

The main purpose of the present invention is to provide a system for feeding waste materials to a plasma melting-furnace in a continuous and safe way.

To achieve the above purpose, the present invention is a feeding system for a plasma melting-furnace. When a waste bucket is carried to be transported by a carrying device, the waste bucket forwards to a prior position and stops until six waste buckets are carried on the carrying device. The waste bucket is automatically transported into a toppling unit. The waste bucket is positioned and toppled on the toppling unit by the toppling device; and is lifted as high as a transporting station of a material feeding unit by a lifting device at the same time. A feeding lid is opened and the waste bucket is hanged into a first feeding room by a positioning hanging-clip unit to be deposed on the transporting station. The positioning hanging-clip unit is automatically withdrawn and the feeding lid is shut, while the waste bucket is punched with holes by a hole-puncher. A first gate is opened and the waste bucket is horizontally moved to a second feeding room by the transporting station. The first gate is shut and a second gate is opened. The waste bucket is horizontally pushed into a third feeding room from the second feeding room by a pushing rod. Then, a second waste bucket is fed. The previous waste bucket in the third feeding room is pushed into a plasma furnace for melting the waste together with the iron bucket. After the previous waste bucket is melted completely, a next waste bucket is fed to be melted. So, the present invention of a feeding system for a plasma melting-furnace feeds waste bucket continuously. By mutually opening and shutting between the feeding lid, the first gate and the second gate and by controlling the exhausting of the exhausted and high-temperature gas into the material feeding room, the waste buckets are fed continuously and the contaminants in the plasma furnace is prevented from leakage, which can be used in related fields of industries for processing radioactive wastes or operating poisonous and high-temperature processes. Accordingly, a novel feeding system for a plasma melting-furnace is obtained.

BRIEF DESCRIPTIONS OF THE DRAWINGS

Figure 2:
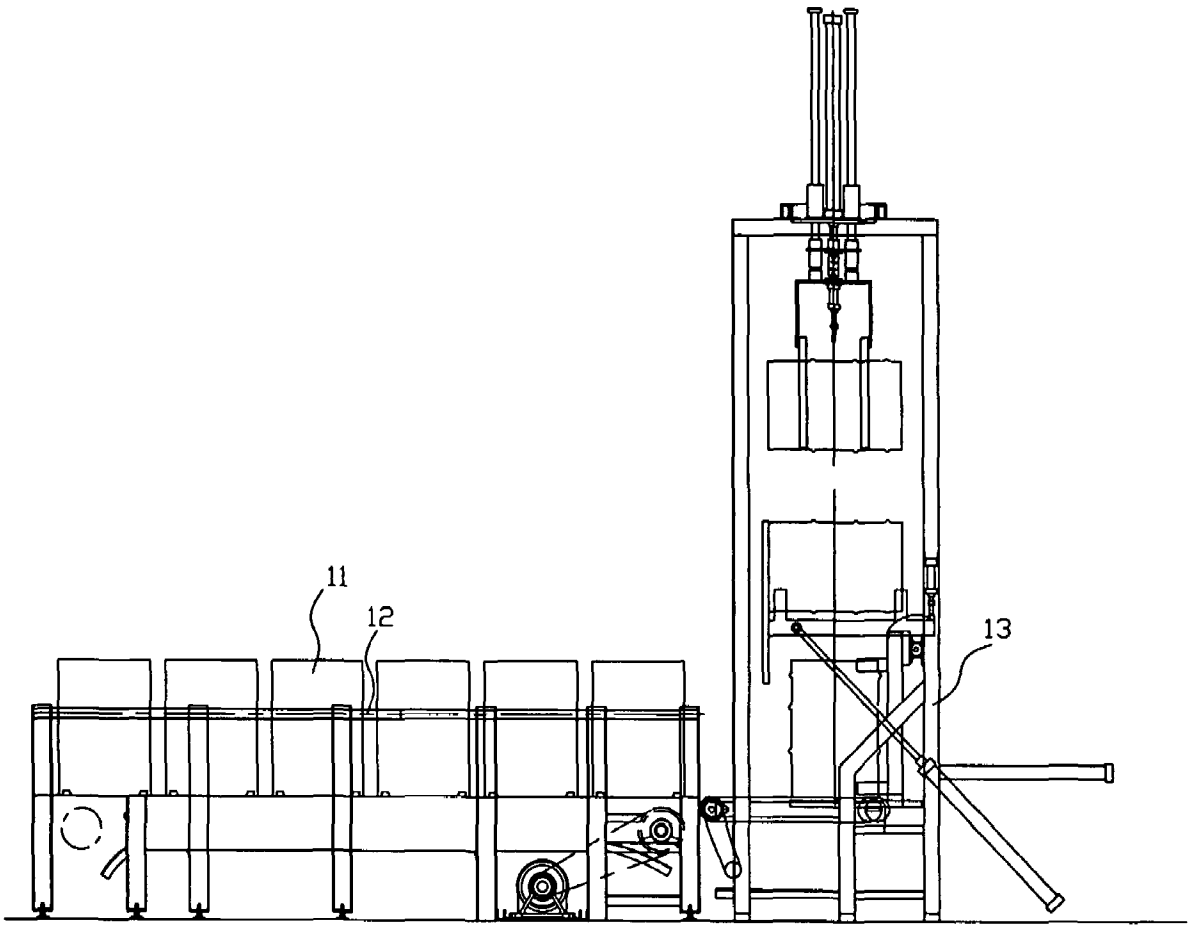
Figure 3:
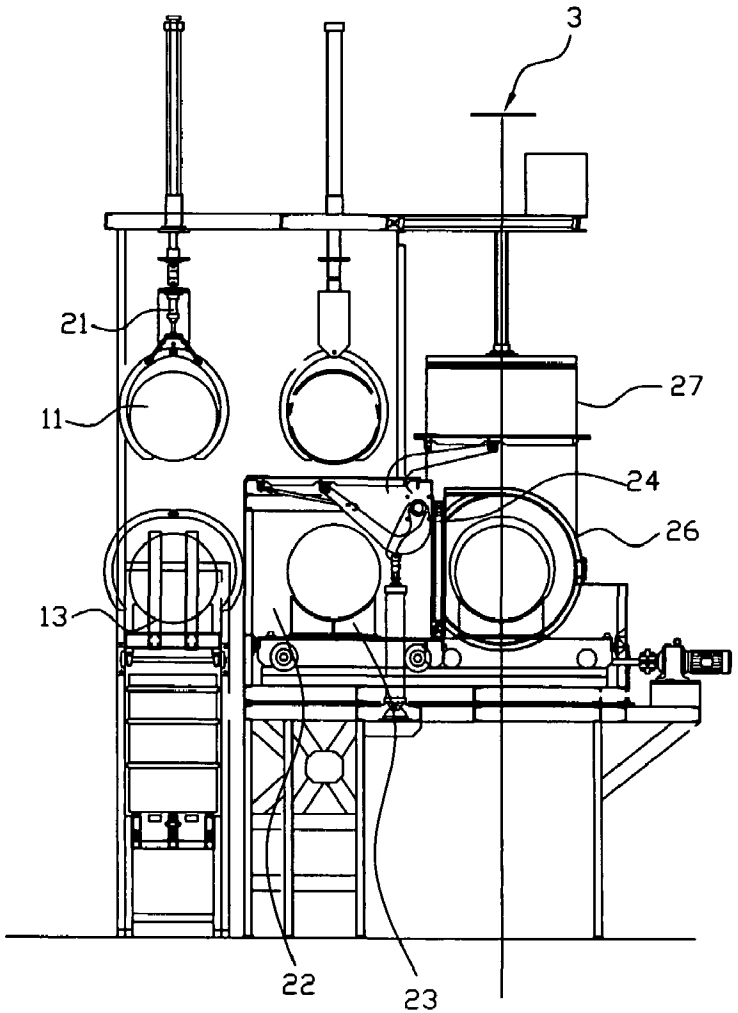
Figure 4:
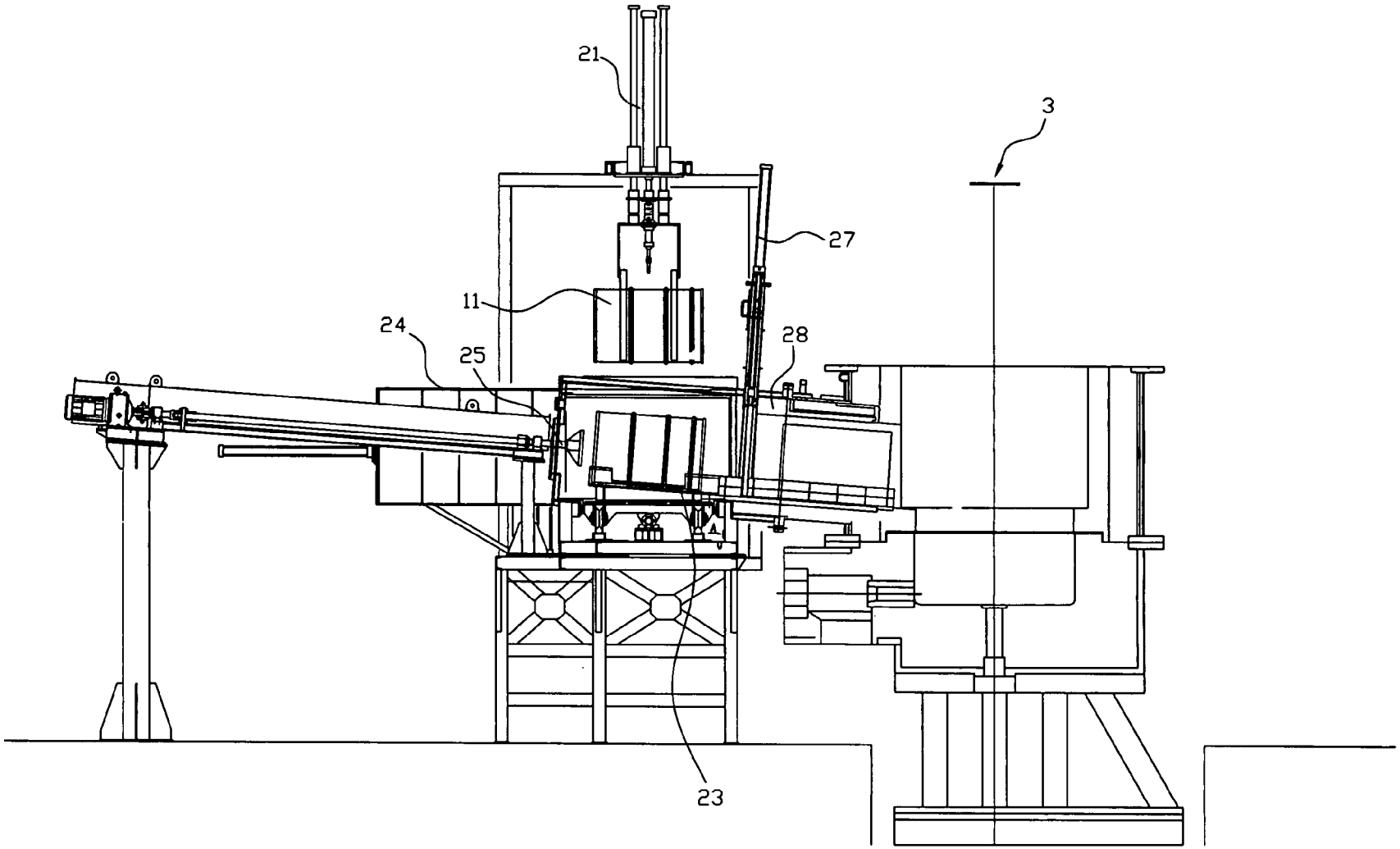

The present invention will be better understood from the following detailed description of the preferred embodiment according to the present invention, taken in conjunction with the accompanying drawings, in which FIG. 1 is a top view showing a preferred embodiment according to the present invention; and FIG. 2 through FIG. 4 are side views showing the preferred embodiment according to the present invention;

DESCRIPTION OF THE PREFERRED EMBODIMENT

The following descriptions of the preferred embodiment are provided to understand the features and the structures of the present invention.

Please refer to FIG. 1 through FIG. 4, which are a top view and side views showing a preferred embodiment according to the present invention. As shown in the figures, the present invention is a feeding system for a plasma melting-furnace, comprising a material carrying unit [1] and a material feeding unit [2]. Therein, a waste bucket [11] with a weight of 300~800 kg (kilogram) is carried by a carrying device [12] after being deposed on the carrying device [12]. The waste bucket [11] is an iron bucket of 55 gallons loaded with non-flammable and low-radioactive waste having little flammable waste. The carrying device [12] is capable of carrying six waste buckets. After a waste bucket [11] is carried to be transported by the carrying device [12], the waste bucket [11] forwards to a prior position so that a next waste bucket [11] can be carried on the carrying device [12] until six waste buckets [11] are deposed on the carrying device [12] (Then, an automatic continuous carrying process can be set with a programmable logic control, and for safety's sake, a demarcation in the whole system is set between the carrying and a feeding of the waste bucket [11]). When a feeding bottom is switched on, the waste bucket [11] is automatically transported into a toppling unit [13]. The toppling unit [13] comprises a lifting device [131] and a toppling device [132] for lifting and toppling the waste bucket [11]. The toppling unit [13] is capable of transporting one waste bucket [11] at one time. The lifting device [131] is actuated with a hydraulic cylinder. The waste bucket [11] is positioned and toppled on the toppling unit [13] by the toppling device [132]; and is lifted as high as a transporting station [23] of the material feeding unit [2] by the lifting device [131] at the same time, where a device for descending the waste bucket [11] can be saved.

The material feeding unit [2] comprises a first feeding room [22], a second feeding room [26] and a third feeding room [28]. The first feeding room [22] is cubic; and the second and the third feeding rooms [26, 28] are cylindrical. The first feeding room [22] is a buffer room for feeding the waste bucket [11], punching holes on the waste bucket [11] and purifying a waste gas in the material feeding unit [2]. The second feeding room [26] is a preparation room for delivering the waster bucket [11]. And the third feeding room [28] is a delivering room for melting the waste bucket [11]. The second feeding room [26] and the third feeding room [28] are connected bottom to head while having 40 of inclination to keep away from condensed water. The three feeding rooms [22, 26, 28] are separated by a first gate [24] and a second gate [27]. An airtight lid is set on the waste entrance port of the first feeding room [22] to prevent the contaminated gas from leakage. And an air entrance which comprises a high efficiency particulate airfilter (HEPA) and a control valve is set on the first feeding room [22] to exhaust and purify the exhausted gas in the material feeding unit [2] and to prevent the exhausted gas of the plasma furnace [3] from entering the material feeding unit [2]. When the pressure of the plasma furnace [3] is too high, the air entrance is shut immediately and the first feeding room [22] and the second feeding room [26] are separated by the first gate [24] to weaken the entering force of the exhausted gas from the plasma furnace [3] into the first feeding room [22]. The second gate [27] is a heat-insulation gate between the second feeding room [26] and the third feeding room [28] during the feeding operation in the material feeding unit [2]. At the bottom of the first feeding room [22] is a horizontal transporting station [23] for transportation. The horizontal transporting station [23] transports the waste bucket [11] by horizontally moving to the second feeding room [26]. The waste bucket [11] is pushed into the third feeding room [28] by a pushing rod [25]. The pushing rod [25] comprises a pushing stroke of 200~250 cm (centimeter) and a speed of 0.02~2 cm per second, which can be adjusted according to the melting rate and can comprise a two-stage positioning control. After the waste bucket [11] is pushed into the third feeding room [28], the pushing rod [25] is withdrawn back to wait for pushing a waste bucket again; or, the waste bucket [11] can be pushed into the plasma furnace [3] by the pushing rod [25] to be interlocked with the system. The rod head of the pushing rod [25] comprises an electromagnetic sucker or a clip device so that the waste bucket [11] can be clipped to be pulled back if it is required.

When the waste bucket [11] is toppled and lifted as high as the transporting station [23] by the toppling unit [23], the positioning hanging-clip unit [21], which is capable of hanging a bucket of 300~800 kg, hangs the waste bucket [11] into the first feeding room [22]. The positioning hanging-clip unit [21] is a PLC (programmable logic control) positioning hanger along X-Z-axle to hang and position the waste bucket [11]. The PLC positioning hanger positions the waste bucket [11] along an X-axle of a track for the positioning hanger and a Z-axle of a length of a cylindrical hanging rod. After the waste bucket [11] is hanged to the transporting station [23] in the first feeding room [22], the positioning hanging-clip unit [21] is automatically withdrawn to the original position. Then, the waste bucket [11 ] is punched with holes at the top and the bottom of the waste bucket [11] by a hole-puncher [221], where the holes are in a distance of 3 cm to the rim and each of the holes comprises a diameter of 1.5 cm to prevent from breaking down when the waste bucket is heated in the plasma furnace [3]. And then, the first gate [24] is opened and the waste bucket [11] is horizontally moved to the second feeding room [26] by the transporting station [23]. Then, the first gate [24] is shut and the second gate [26] is opened. The transporting station [23] comprises a speed of 0~2 cm per second and a horizontal movement with a guiding bar between the first feeding room [22] and the second feeding room [26]. The second feeding room [26] comprises a shell of a water jacket layer to cool down the temperature heated by the plasma furnace [3]. The second feeding room [26] comprises an inner wall of a high-temperature resistant paint to reflect radiant heat. The waste bucket [11] is horizontally pushed into the third feeding room [28] from the second feeding room [26] by the pushing rod [25]. The pushing rod [25] comprises a ball-bearing bar and a speed controller. The waste bucket [11] is finally pushed into the plasma furnace [3] to be melted while referring to the melting process of a previous waste bucket [11]. The second feeding room [26] and the third feeding room [28] are connected bottom to head having 4° of inclination and are connected to a feeding port of the plasma furnace. The inner wall of the third feeding room is made of a fire-resist material and comprises a shell of a water jacket layer for cooling down the temperature. The inner wall of the third feeding room 28 comprises a distance of 5.5 cm to the top rim of the waste bucket [11] as a space for a cover clip of the waste bucket [11] to travel through so that the cover clip is prevented from being stuck or having any difficulty on transportation owing to any extruding deformation of the waste bucket [11].

As a result, the present invention is a feeding system for a plasma melting-furnace, which is fed with a waste bucket to be melted. When the feeding button is switched on to automatically feed a waste bucket [11], the pushing rod [25] is automatically withdrawn back and the second gate [27] is automatically shut. The first gate [24] is opened and the transporting station is horizontally moved from the second feeding room [26] to the first feeding room [22]. The first feeding room [22] is shut and the feeding lid is opened. The waste bucket [11] is hanged into the first feeding room [22] by the positioning hanging-clip unit [21] to be deposed on the transporting station [23]. The feeding lid is shut. After the waste bucket [11] is punched with holes in the first feeding room [22], the first gate [24] is opened and the waste bucket [11] is transported to the second feeding room [26] by the transporting station [23]. The first gate [24] is shut and the second gate [27] is opened for pushing the waste bucket [11] to the third feeding room [28] by the pushing rod [25]. After two waste buckets [11] are fed, a waste bucket [11] is pushed into the plasma furnace [3] to be melted along with the iron bucket where an actual melting situation is considered. Until the melting process for the waste bucket [11] is done, the pushing rod 25 is automatically withdrawn. Finally the second gate is shut and the above steps are repeated again to load another waste bucket [11].

By doing so, the present invention of a feeding system for a plasma melting-furnace feeds waste bucket continuously. By mutually opening and shutting between the feeding lid, the first gate and the second gate and by the PLC interlock for feeding the waste buckets sequentially, the plasma furnace is operated under a negative pressure to obtain environment protection together with that the contaminant in the plasma furnace is prevented from leakage. The present invention uses water jackets to eliminate radiant heat and uses air entered from the air entrance to exhaust the remaining exhausted gas into the plasma furnace so that the elements of the present invention are not hurt by the high temperature of exhausted gas of the plasma furnace. Therefore, the present invention can be used in related fields of industries for processing radioactive wastes.

To sum up, the present invention is a feeding system for a plasma melting-furnace, where, by mutually opening and shutting between a feeding lid, a first gate and a second gate of a material feeding unit and by a special design to exhaust gas, waste materials are fed continuously; contaminants from a plasma furnace is prevented from leakage; and elements are kept from being hurt by high temperature.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A feeding system for a plasma melting-furnace, comprising:

a material carrying unit carrying at least one waste bucket, said material carrying unit comprising a carrying device, a positioning hanging-clip unit and a toppling unit; and a material feeding unit feeding said waste bucket, said material feeding unit comprising a first feeding room, a transporting station, a pushing rod, a first gate, a second feeding room, a second gate and a third feeding room, wherein said first feeding room comprises a hole-puncher adjacent the first feeding room, an air entrance and a feeding lid, said waste bucket being punched with holes and pushed into a plasma furnace to be melted, wherein said hole-puncher punches a hole having a diameter of 1.5 cm (centimeter), wherein said pushing rod comprises a speed of 0.02~2 cm per second, wherein said pushing rod comprises a pushing stroke of 200~250 cm.

2. The system according to claim 1, wherein said air entrance is externally connected to a high efficiency particulate airfilter and a control valve.

3. The system according to claim 1, wherein said carrying device comprises a maximum loading of six of said waste buckets.

4. The system according to claim 1, wherein said waste bucket comprises a loading of 300~800 kilograms.

5. The system according to claim 1, wherein a waste in said waste bucket is a non-flammable and low-level radioactive waste with flammable waste.

6. The system according to claim 1, wherein said waste bucket is an iron bucket of 55 gallons.

7. The system according to claim 1, wherein said positioning hanging-clip unit is a PLC (programmable logic control) positioning hanger along X-axle and Z-axle.

8. The system according to claim 7, wherein said positioning hanging-clip unit positions said waste bucket along an X-axle of a track for said positioning hanger and along a Z-axle of a length of a cylindrical hanging rod.

9. The system according to claim 1, wherein said waste bucket comprises a 5.5 cm of separation between side surface of said waste bucket and inner surface of said third feeding room.

10. The system according to claim 1, wherein said transporting station comprises a speed of 0~2 cm per second.

* * * * *